US006612439B1

(12) United States Patent
Levine

(10) Patent No.: US 6,612,439 B1
(45) Date of Patent: Sep. 2, 2003

(54) CAN HOLDER FOR USE WITH TRANSPORTATION RING

(76) Inventor: Norman Levine, 4501 S. Santa Fe Ave., Vernon, CA (US) 90058

( * ) Notice: Subject to any disclaimer, the term of this patent is extended or adjusted under 35 U.S.C. 154(b) by 116 days.

(21) Appl. No.: 10/174,557

(22) Filed: Jun. 19, 2002

(51) Int. Cl.[7] ..... B65D 21/32
(52) U.S. Cl. ..... 206/501; 206/821
(58) Field of Search ..... 206/503, 501, 206/821, 509; 211/59.4

(56) References Cited

U.S. PATENT DOCUMENTS 3,180,537 A * 4/1965 Collins ..... 222/480
3,228,857 A * 1/1966 McCormick ..... 435/283.1
3,354,515 A * 11/1967 Robinson ..... 24/288
5,636,753 A * 6/1997 Wilkinson et al. ..... 211/59.4
5,915,557 A 6/1999 Levine

* cited by examiner

*Primary Examiner*—Joseph M. Moy
(74) *Attorney, Agent, or Firm*—Edgar W. Averill, Jr.

(57) ABSTRACT

A can holder for supporting a smaller can on top of a larger can during shipping in a carton. The can holder fits closely within the raised lip around the cover of the larger can. The can holder has one, two, or three raised cylindrical rings are capable of holding the bottom of a smaller can within one of the rings. When the larger can, the can holder, and the smaller can are placed in a proper sized carton, the lid of the carton holds the smaller can in the ring on the can holder and prevents if from shifting during shipping.

10 Claims, 4 Drawing Sheets

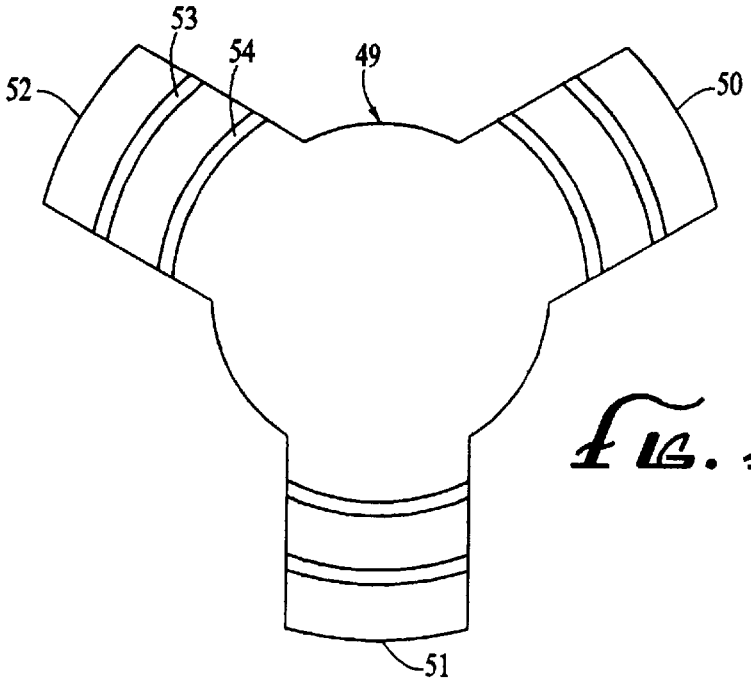
FIG. 4
FIG. 5
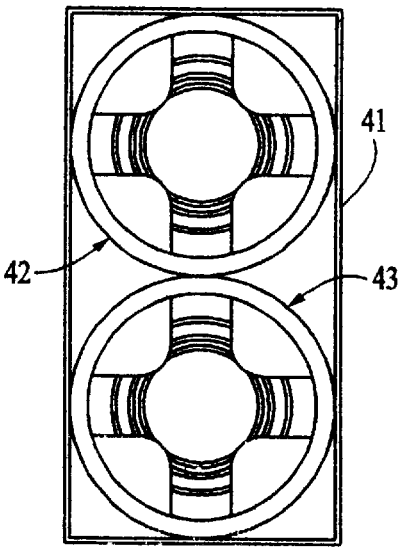
FIG. 6
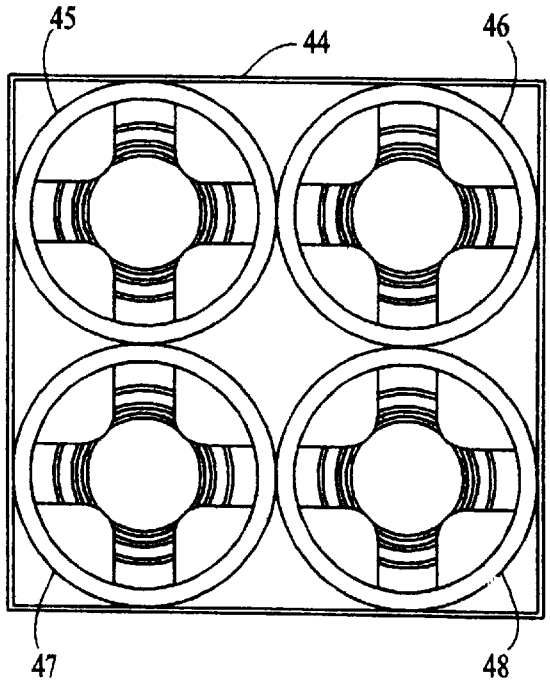

CAN HOLDER FOR USE WITH TRANSPORTATION RING

BACKGROUND OF THE INVENTION

Transportation rings are commonly used to hold the lid or cover on a paint can or other liquid containing can during shipping. Cans protected with transportation rings can be dropped from a height of 1.48 meters onto a concrete floor without the lid coming off the can. Without the transportation ring, the lid would become dislodged from the can and the contents of the can would spill out onto the floor. One style of transportation ring is shown in applicant's U.S. Pat. No. 5,915,557.

Many types of products require a catalyst which must be separated from the resin until ready for use. For instance, urethane resins are often supplied with a separate catalyst which is only used when the urethane resin is ready to be applied. It can be readily understood that the shipping of a large can and a small can would tend to result in the smaller can being imperfectly supported within a shipping container so that it would shift from side to side if the container is dropped. One approach used to prevent such shifting is the use of a foam block with an opening which surrounds the smaller can. The foam block, unfortunately, creates a waste disposal problem and in some countries is unacceptable as a packing material.

BRIEF SUMMARY OF THE INVENTION

It is an object of the present invention to provide a transportation securement system which is capable of supporting a smaller can on top of a larger can during shipping or handling in a carton.

The present invention is for a can holder supported in the center of a transportation ring which can holder has a central disk which has at least three arms extending radially outwardly therefrom. Each arm has an arcuate outer edge which touches the plug bead which surrounds the generally flat central portion of the lid of the larger can. When the can holder disk is placed on the lid of the larger can, it is prevented from lateral movement by contact between its arms and the plug bead. The can holder also has at least one raised circular can centering ring centered about the center of the central disk. The can centering ring has an inside surface which snugly fits the outside surface of the bottom of the smaller can. When the larger and smaller can are contained in a box with a lid which rests against the top of the smaller can, the smaller can is retained in a fixed position with respect to the larger can. It will not shift, even if the larger and smaller can are dropped. It is not made of a foam so that it is recyclable or disposable without the objections which foam members cause. Preferably, the can holder has three or four arms and has three circular can centering rings.

BRIEF DESCRIPTION OF THE DRAWINGS

FIG. 4 is a plan view of an alternate configuration of the can holder of FIG. 1.

FIG. 5 is a top view of a carton containing two larger and smaller cans, each utilizing the can holder of the present invention.

FIG. 6 is a top view of four larger and smaller can pairs utilizing four can holders of the present invention.

DESCRIPTION OF THE PREFERRED EMBODIMENTS

Figure 1:
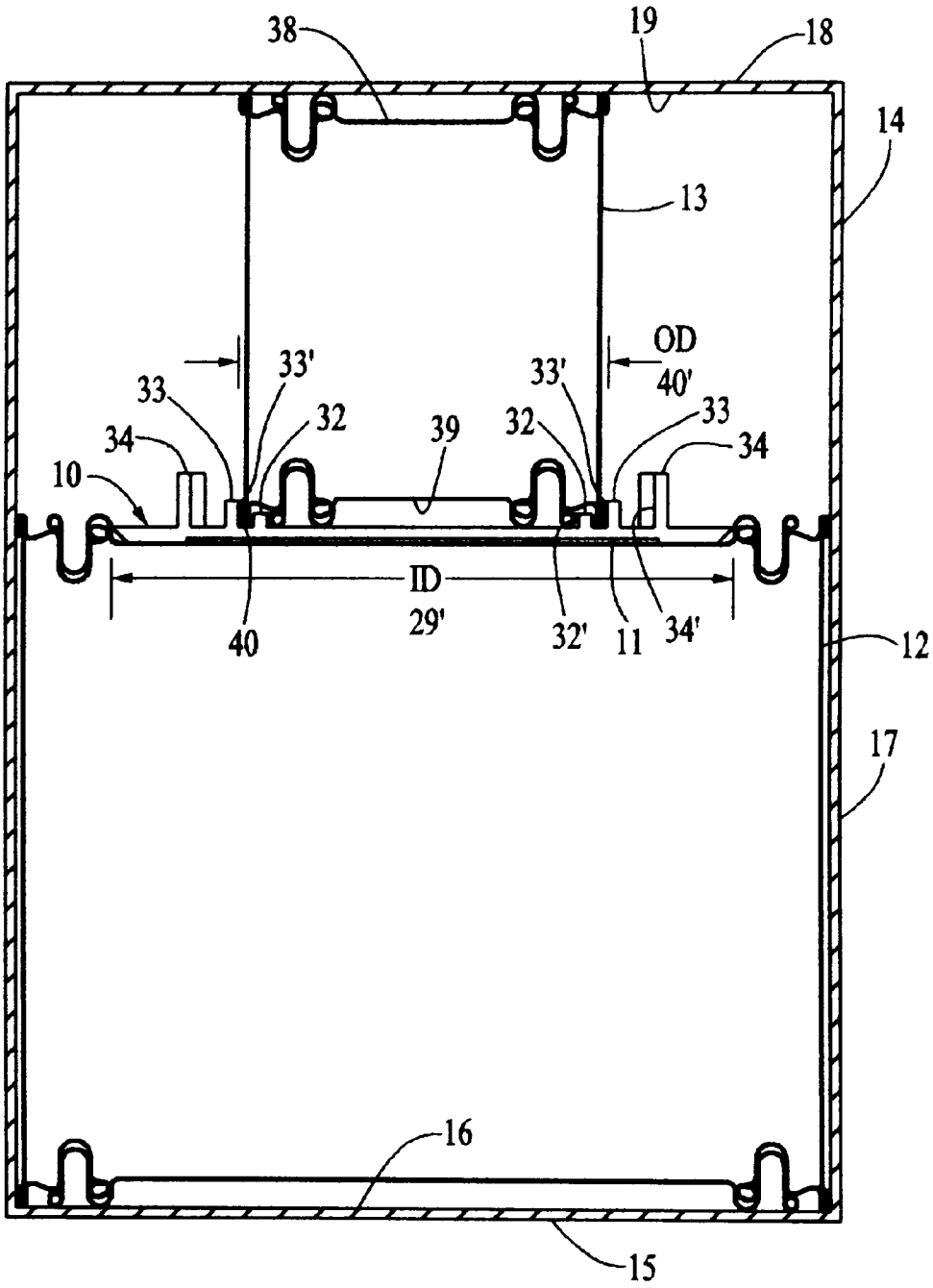
FIG. 1 is a cross-sectional view of a larger can and a smaller can separated by a can holder of the present invention and confined in a carton.

The can holder of the present invention is shown in cross-sectional view in FIG. 1 and indicated generally by reference character 10. Can holder 10 is resting on the lid 11 of larger can 12. Can holder 10 may be a part of a transportation ring 10' as shown in FIG. 1. Can holder 10 is supporting smaller can 13. Cans 12 and 13 are held within a carton 14 which is typically a corrugated cardboard carton. Carton 14 has a bottom 15 with an upper surface 16, four sides 17, and a top 18, with an inner surface 19.

Figure 2:
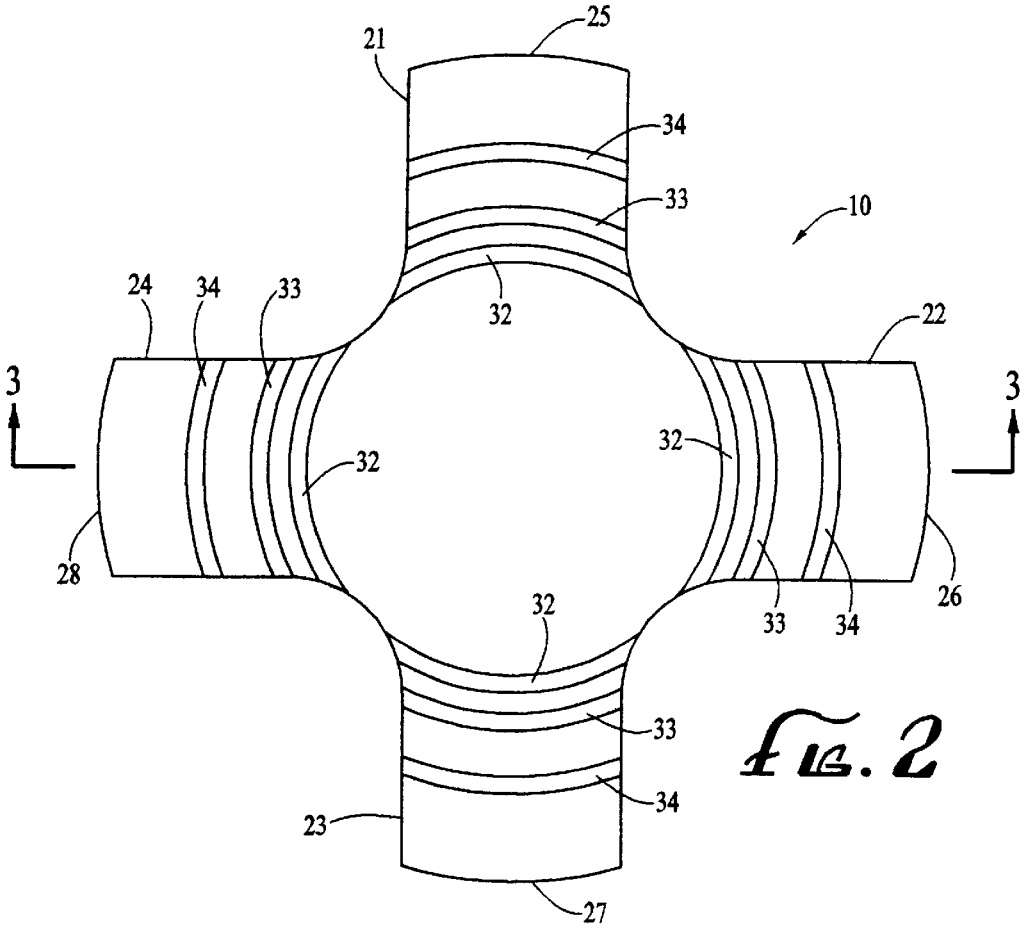
FIG. 2 is a plan view of a first configuration of the can holder of FIG. 1.

Can holder 10 is shown in FIG. 2 and has a central disk 10 from which four arms 21 extend. Each arm has an arcuate outer edge 25, 26, 27, and 28. These arcuate outer edges contact the inside wall 29 of raised circular plug bead 30 shown in FIG. 1. Plug bead inside wall 29 has an inside diameter 29'. In this way, the can holder 10 can be simply placed on the generally flat recessed cover portion.

Can holder 10 has three circular can centering rings 32, 33, and 34. These rings are shown in cross-sectional view in FIG. 3. Each ring can be seen to have an inner cylindrical wall 32', 33', and 34'. These walls are sized so that they fit standard can sizes. For instance, the inner ring may support a half-pint can, the center ring 33 may support a one pint can, and the outer ring 34 may support a one quart can.

Figure 3:
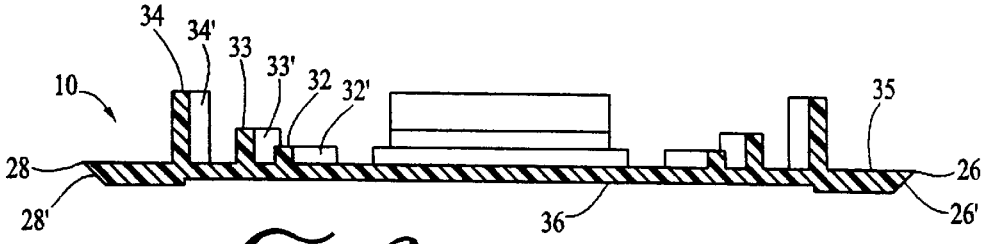
FIG. 3 is a cross-sectional view taken along line 3—3 of FIG. 2.

Can holder 10 can be seen in FIG. 3 to have an upper surface 35 and a lower surface 36. Two of the arcuate outer edges are indicated by reference characters 26 and 28. The arcuate outer surfaces are chamfered as indicated by reference characters 26' and 28' in FIG. 3. This avoids contact with curved edge 37 shown in FIG. 1.

Smaller can 13 has a top 38, a generally flat recessed bottom 39. Bottom 39 is surrounded by a downwardly extending circular plug bead 40. Downwardly extending circular plug bead 40 has an outside diameter 40' indicated in FIG. 1.

Plug bead 40 raises the bottom 39 of can 13 above raised circular can centering ring 32. The smaller can 13 is supported by contact between the inner cylindrical wall 33' and the outer surface of plug bead 40.

The can holder of the present invention can be economically fabricated from polymers such as polypropylene and preferably polyethylene since the ring is not subjected to a great deal of force. Cartons can be made to hold two can pairs, such as carton 41 in FIG. 5, which holds pairs 42 and 43. Four can pairs can be held as shown in FIG. 6 by carton 44. Carton 44 holds can pairs 45, 46, 47, and 48.

Figure 7:
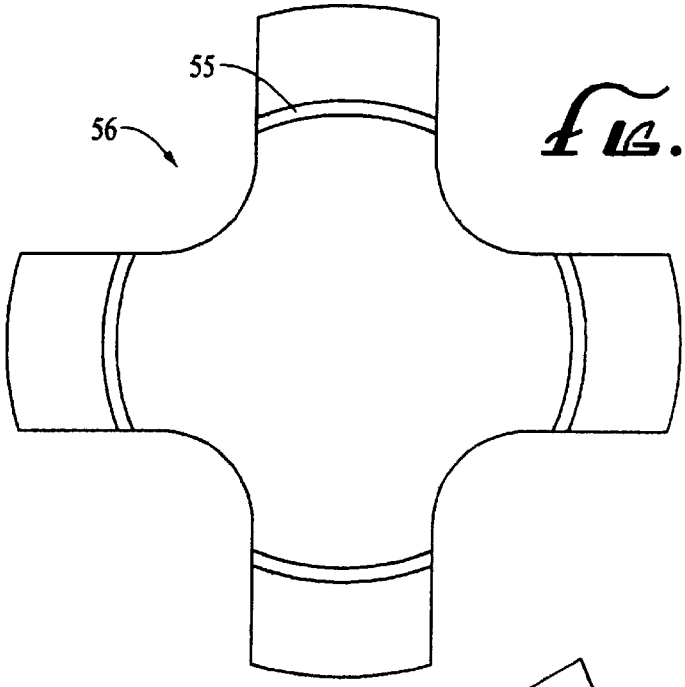
FIG. 7 is a plan view of a can holder having a single can centering ring.
Figure 8:
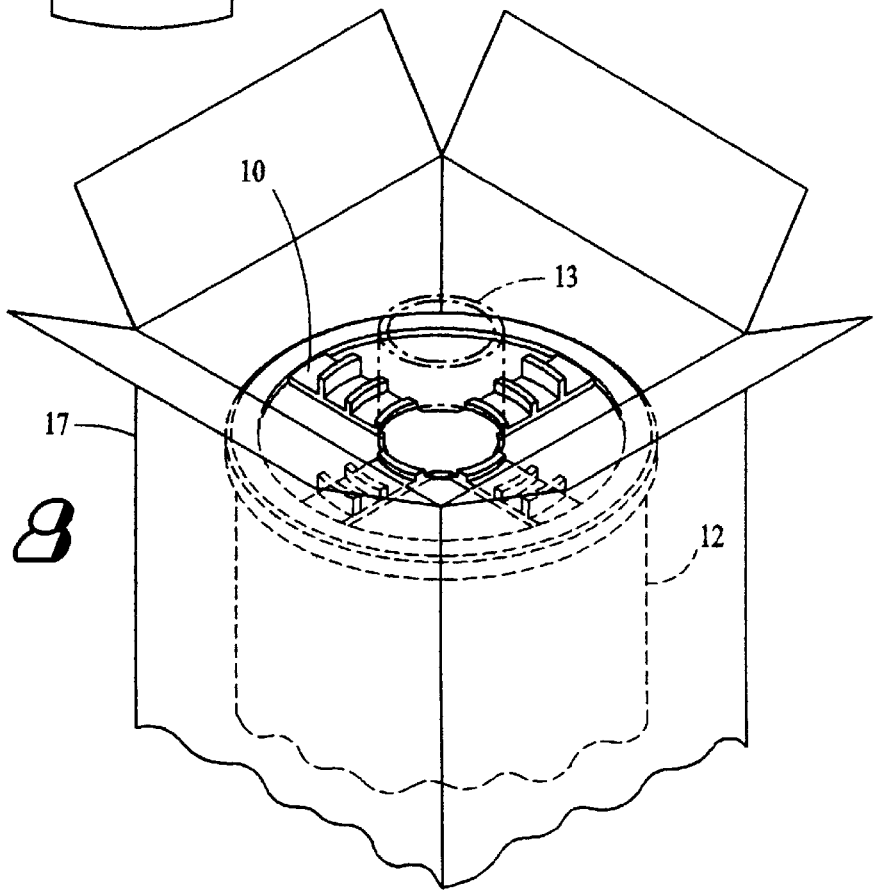
FIG. 8 is a perspective view showing the can holder, cans and container of FIG. 1.

While the can holder discussed above has assumed there are four arms, as shown in FIG. 2, it can utilize three arms, as shown by can holder 49 in FIG. 4. Transportation ring 49 has arms 50, 51, and 52. The can holder need not have three raised circular can centering rings and, instead, may have two, as shown by rings 53 and 54 in FIG. 4, or may have a single ring 55, as shown in can holder 56 in FIG. 7.

The can holder of the present invention is light in weight, easy to fabricate by injection molding, readily recyclable, or disposable, especially as compared to the foamed members presently in use. It is very easy to apply since it merely need be placed on the lid of the larger can and topped by placing the smaller can in one of its cylindrical walls.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A can holder for supporting a smaller can on top of a larger can during shipping in a carton, said larger can having a lid having a generally flat recessed cover portion surrounded by a raised circular plug bead having a plug bead inside wall having an inside diameter and said smaller can having a generally flat, recessed bottom surrounded by a downwardly depending, circular bottom double seam having a double seam outside diameter which double seam forms the base resting surface of the smaller can, said can holder comprising:

a central disk having a center and having a plurality of at least three arms extending radially outwardly therefrom, each arm having an arcuate outer edge having a radius of curvature centered at the center of said central disk and equal to one half of the plug bead inside diameter so that the arcuate outer edges of each arm rests against the plug bead inside wall and said central disk and said at least three arms having an upper surface and a bottom surface and said can holder having at least one raised, circular can centering ring centered about the center of said central disk, said at least one raised, circular can centering ring being formed on the upper surface of said arms, said at least one raised, circular can centering ring having an inside diameter equal to the outside diameter of the downwardly depending circular bottom double seam of the smaller can whereby the can holder may be placed on the generally flat recessed cover portion of the lid of the larger can and its arcuate outer edges touch the raised circular plug bead of the lid of the larger can and its at least one raised, circular can centering ring surrounds said downwardly depending circular bottom double seam thereby preventing the lateral movement of said smaller can with respect to said larger can.

2. The can holder of claim 1 wherein said central disk has four arms.

3. The can holder of claim 1 wherein said central disk has three arms.

4. The can holder of claim 1 wherein said can holder has three circular can centering rings.

5. The can holder of claim 4 wherein the three circular car centering rings comprise an outer ring, a center ring, and an inner ring and wherein the outer ring is raised from said can holder higher than said center ring and said center ring is raised from said can holder higher than said inner ring.

6. The can holder of claim 4 wherein an inner surface of each of said circular can centering rings is cylindrical except for a space between arms.

7. The can holder of claim 1 wherein each of said plurality of at least three arms has a chamfered bottom edge.

8. The can holder of claim 1 wherein said can holder is fabricated from a polymer.

9. The can holder of claim 8 wherein said polymer is polyethylene.

10. A shipping carton and container assembly containing at least one pair of cans consisting of a larger can and a smaller can, said shipping carton and container assembly comprising:

a shipping carton having a bottom with an upper surface, four sides and a top with an inner surface;

a larger can resting on the upper surface of the bottom of the container, said larger can having a lid having a generally flat recessed cover portion surrounded by a raised circular plug bead having a plug bead inside diameter and a plug bead inside cylindrical wall;

a smaller can having a top, a generally flat, recessed bottom surrounded by a downwardly depending, circular bottom double seam having a double seam outside diameter which double seam forms the base resting surface of the smaller can; and a can holder having a central disk resting on the generally flat recessed cover portion of said lid of said larger can, said central disk having a center and having a plurality of at least three arms extending radially outwardly therefrom, each arm having an arcuate outer edge having a radius of curvature and outside diameter so that it rests against said plug bead inside cylindrical wall and said central disk and said at least three arms having an upper surface and a bottom surface and said can holder has at least one raised, circular can centering ring centered about a center of said central disk, said at least one raised, circular can centering ring being formed on the upper surface of said arms, said at least one raised, circular can centering ring having an inside diameter equal to the outside diameter of the downwardly depending circular bottom double seam of the smaller can whereby the at least one raised, circular can centering ring surrounds said downwardly depending circular bottom double seam of the smaller can thereby preventing the lateral movement of said smaller can with respect to said larger can and wherein said top of said shipping carton is dimensioned so that its inner surface rests against the top of the smaller can preventing it from lifting off the can holder.

* * * * *